US006402292B1

(12) United States Patent
Ninomiya

(10) Patent No.: US 6,402,292 B1
(45) Date of Patent: Jun. 11, 2002

(54) INK JET PRINTING APPARATUS WITH PRELIMINARY DISCHARGE CONTROL

(75) Inventor: Takayuki Ninomiya, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/221,841

(22) Filed: Dec. 29, 1998

(30) Foreign Application Priority Data

Jan. 7, 1998 (JP) ..... 10-001804

(51) Int. Cl.[7] ..... B41J 2/165
(52) U.S. Cl. ..... 347/35
(58) Field of Search ..... 347/35, 23, 24, 347/22, 98

(56) References Cited

U.S. PATENT DOCUMENTS 5,270,738 A * 12/1993 Takahashi et al. ..... 347/24
5,659,342 A * 8/1997 Lund et al. ..... 347/35
5,680,162 A 10/1997 Taylor et al. ..... 347/35
5,717,446 A 2/1998 Teumer et al. ..... 347/35

FOREIGN PATENT DOCUMENTS

| | | | |
|---|---|---|---|
| EP | 0 705 699 | 4/1996 | |
| EP | 0 726 155 A2 * | 8/1996 | ..... B41J/2/21 |
| EP | 0 764 535 | 3/1997 | |
| EP | 0 802 060 | 10/1997 | |
| JP | 8-216400 | 8/1996 | |

* cited by examiner

*Primary Examiner*—David F. Yockey
(74) *Attorney, Agent, or Firm*—Fitzpatrick, Cella, Harper & Scinto

(57) ABSTRACT

An ink jet printing apparatus includes a plurality of heads for discharging liquids used for plural types of prints each exhibiting a different attribute. Further the apparatus includes a control apparatus for adjusting and controlling a timing of a preliminary discharge for maintaining a discharge not contributing to records by said plurality of heads, per attribute of the liquids to be discharged in such a manner that droplets of the liquids exhibiting the same attribute are discharged to the same position.

6 Claims, 7 Drawing Sheets

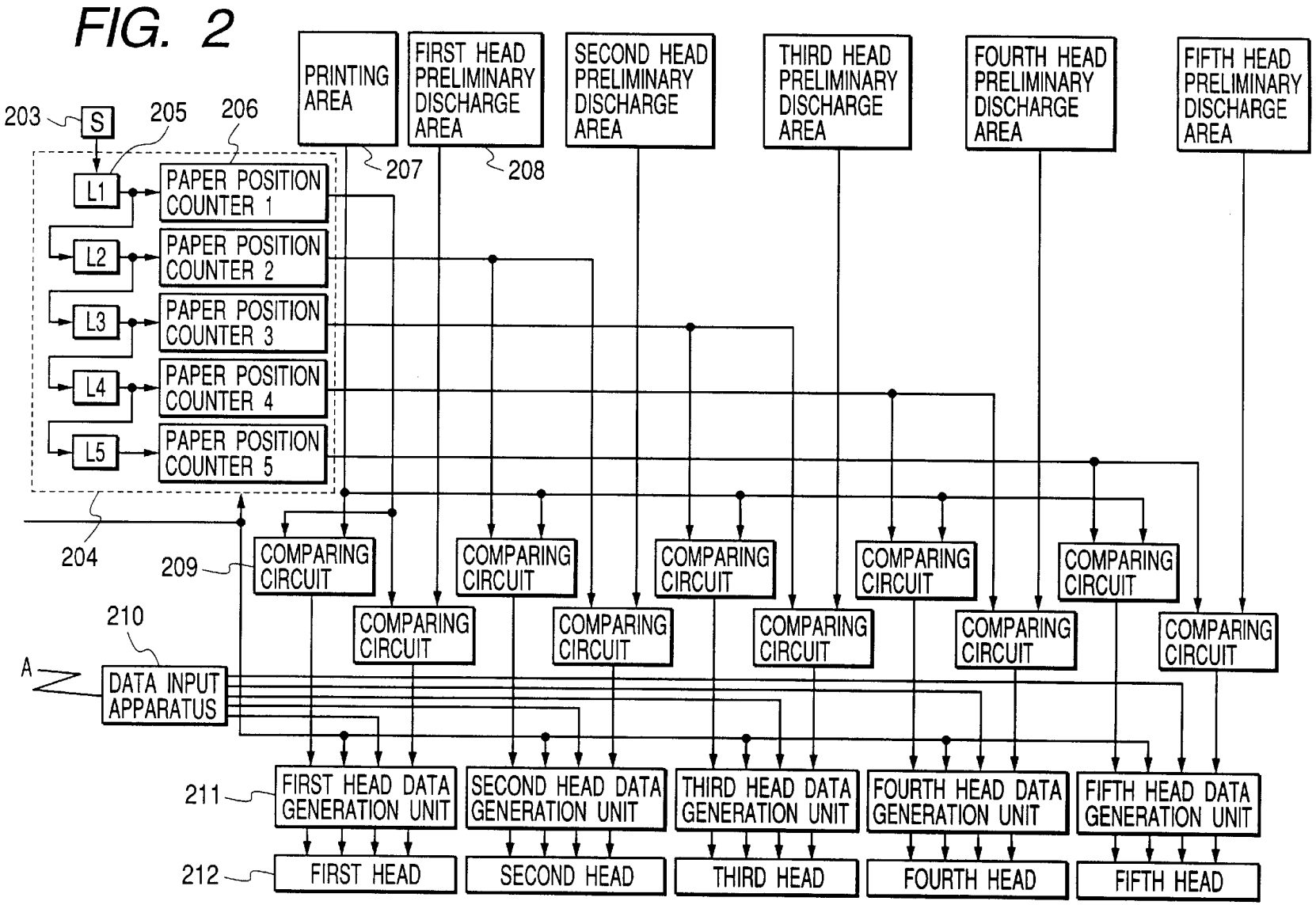
FIG. 2
PRINTING AREA
FIRST HEAD PRELIMINARY DISCHARGE AREA
SECOND HEAD PRELIMINARY DISCHARGE AREA
THIRD HEAD PRELIMINARY DISCHARGE AREA
FOURTH HEAD PRELIMINARY DISCHARGE AREA
FIFTH HEAD PRELIMINARY DISCHARGE AREA
207
208
203
S
205
206
L1
L2
L3
L4
L5
PAPER POSITION COUNTER 1
PAPER POSITION COUNTER 2
PAPER POSITION COUNTER 3
PAPER POSITION COUNTER 4
PAPER POSITION COUNTER 5
204
COMPARING CIRCUIT
209
DATA INPUT APPARATUS
210
A
FIRST HEAD DATA GENERATION UNIT
SECOND HEAD DATA GENERATION UNIT
THIRD HEAD DATA GENERATION UNIT
FOURTH HEAD DATA GENERATION UNIT
FIFTH HEAD DATA GENERATION UNIT
211
FIRST HEAD
SECOND HEAD
THIRD HEAD
FOURTH HEAD
FIFTH HEAD
212

INK JET PRINTING APPARATUS WITH PRELIMINARY DISCHARGE CONTROL

BACKGROUND OF THE INVENTION

1. Field of the Invention

The present invention relates to an ink jet printing apparatus including a unit for recovering a function of a nozzle defined as an ink discharge member of an ink jet head for printing a print image by jetting ink liquid droplets.

2. Related Background Art

In recent years, a resolution of an ink jet printing apparatus has increasingly been enhanced. The resolution, which was hitherto on the order of 180 dpi, increases up to 360 dpi and further to 600 dpi more than three times as high as the above. The resolution is thus increased, which turns ink liquid droplets into much finer liquid droplets and further enhances a density of a nozzle arrangement. With this higher resolution, a variety of control operations and works have been implemented with respect to nozzle members defined as ink discharging portions of the ink jet printing apparatus in order to obtain a discharge stability. For example, when the printing ceases for a long period of time, a nozzle surface is capped so as not to unnecessarily evaporate the water content from an ink liquid in the nozzle member. This prevents the ink from being unable to be discharged due to an increase in viscosity of the ink liquid in the nozzle member and a composite factor such as a fixation of the ink adhered to the periphery of the nozzle, an adhesion of dusts and the increased viscosity of the ink in the nozzle member. Further, there is conducted an operation of sucking the ink liquid within the nozzle. A first purpose of this operation is to forcibly remove the ink liquid of which the viscosity increases at the nozzle if the ink jet printing apparatus has been in an unused state for a long time. A second purpose of the operation described above is to remove bubbles existing inside the ink liquid in the nozzle member. Moreover, the nozzle surface is exposed directly to the atmospheric air during the printing process, and therefore the viscosity of the ink liquid increases on the nozzle surface. Then, a discharge resistance rises due to the ink layer having the increased viscosity, with the result that the liquid droplets can not be discharged with a stability. Further, for obviating an increased concentration of a color ink liquid due to the increased viscosity of the ink, the ink is discharged when starting the print and during the printing, thereby obtaining the stable discharge (which operation is referred to as a preliminary discharge). A variety of nozzle recovering operations based on the method described above have hitherto been carried out, however, particularly a preliminary discharging method of discharging the ink liquid droplets into a cap for the preliminary discharge at an interval of a fixed time by way of the nozzle recovering operation during the printing, is conceived as a quite important nozzle recovering method. In a serial ink jet printing apparatus having a plurality of nozzle rows consisting of a comparatively small number of printing nozzles, e.g., approximately 128 nozzles, the preliminary discharge involves the use of a method of carrying out the preliminary discharge by moving a carriage mounted with the nozzles to a predetermined preliminary discharge position. Further, in a high-speed full-multi printing apparatus including a plurality of nozzle rows consisting of a comparatively large number of printing nozzles, e.g., approximately 5200 nozzles, with respect to an electrostatic absorption carrier in which the carrier apparatus of the printing apparatus uses a belt etc., or an air suction adsorbing method, or an intermediate transfer body system using a drum and a transfer body system, there is taken a method of effecting the preliminary discharge on a belt used for the electrostatic adsorption carrier or in an arbitrary position or a random position on the drum used in the transfer body system.

The preliminary discharge explained above presents no problem in terms of a re-usability, a disposal processing property, a preserving property and an intra-appliance dangerousness when the preliminary discharge is executed using the liquids exhibiting the same attributes, e.g., the inks of the same color stuff, the same concentration and the same chemical characteristic. However, in the case of simultaneously using the liquids having different attributes, for instance, when enhancing an image quality by use of the above liquid and a printability enhancing liquid classified as one kind of color stuff reactive substances, there might arise an inconvenience in the preliminary discharge described above. Herein, the enhancement of the printability implies an enhancement of image qualities such as a density, a saturation, a degree of sharpness of an end portion and a dot diameter etc., an enhancement of a fixing property of the ink, and an enhancement of a weatherability such as a water resistance and a light resistance, i.e., an image preserving property. Further, the term "insoluble" implies such a:phenomenon that the anion radical contain in a dye within the ink and the cation radical of a cation substance which is contained in the printability enhancing liquid, cause interaction ion-wise enough to produce ion-coupling, and the color stuff (dye) uniformly solved in the ink is separated from the solution. Note that according to the present invention, even if all the dyes in the ink are not necessarily dissolved, there are obtained effects such as enhancements of the density, the character quality and the fixing property. Moreover, the term "agglutination" is used having the same meaning as the term "insoluble" when the-color stuff used in the ink is an aqueous dye containing, e.g., the anion radical. Further, if the color stuff used in the ink is a pigment, a pigment dispersant or the pigment surface and the cation radical of the cation substance which is contained in the printability enhancing liquid, cause ion-wise interaction, with the result that the pigment is brought into a dispersing destruction including an enlargement of a particle-size of the pigment. Normally, with the agglutination described above, the viscosity of the ink increases.

In the full-multi printing apparatus using the printability enhancing liquid exhibiting the performance explained above, when effecting the preliminary discharge onto the carrier belt in order to ensure a discharge reliability of the printing head, and if the printing heads for respective colors including the printing head for discharging the printability enhancing liquid onto the carrier belt execute the preliminary discharges in proper positions on the carrier belt, the ink dyes become insoluble due to the printability enhancing liquid and the ink dye as well, and a coagulation thereof occurs on the carrier belt. In general, when the coagulation described above occurs on the carrier belt, there declines a cleaning property of an ink cleaning apparatus for removing the inks on the carrier belt to prevent the inks from being transferred on the next printing paper. The decline of the cleaning property is that there decreases a quantity of the inks adsorbed to the cleaner for removing the inks adhered onto the carrier belt, and there grows a possibility of the inks being adhered to the next printing paper. Further, the adhesion of the inks onto the carrier belt, especially when the electrostatic adsorption carrier is carried out, might cause changes in dielectric constant and on volume resistivity, which in turn leads to a change in a paper adsorbing force.

The change in the adsorbing force of the carrier belt changes a condition under which cockling thereof occurs, with the result that a floating quantity of the printing paper above the carrier belt varies. If the paper floating quantity increases, the printing paper is brought into contact with the printing head, which might cause a paper jam. This is considered inappropriate as the printing system.

Moreover, in a printing apparatus having an ink circulating system, a system for recovering only the liquids assuming the same color, composed of the same color stuff and having the same concentration is, not in an economic aspect, required to be structured when in the printing process or in a discharge portion protecting state.

Further, in the high-speed printing system required to execute the preliminary discharge onto the intermediate transfer body or the printing paper carrier member for maintaining the ink discharge portion, there arises a necessity for changing the cleaning materials for the preliminarily-discharged member, depending upon cleaning properties of the various inks.

SUMMARY OF THE INVENTION

It is a primary object of the present invention to obviate the problems described above.

To accomplish this object, according to a first aspect of the present invention, an ink jet printing apparatus including a plurality of heads for discharging liquids used for plural types of prints each exhibiting a different attribute, comprises a control unit for adjusting and controlling a timing of a preliminary discharge for maintaining a discharge not contributing to records by the plurality of heads, per attribute of the liquids to be discharged in such a manner that droplets of the liquids exhibiting the same attribute are discharged to the same position.

According to a second aspect of the invention, in the ink jet printing apparatus according to the first aspect, the liquids exhibiting the different attributes are an ink containing a coloring agent, and a liquid, not containing the coloring agent, for enhancing a quality of an image formed by the ink.

According to a third aspect of the invention, in the ink jet printing apparatus according to the second aspect of the invention, the head is of a serial scan type, the printing apparatus provides one of areas exceeding a printing range with a preliminary discharge position for the ink and the other area with a preliminary discharge position for the image quality enhancing liquid, and the control unit performs control in such a manner that the liquids are discharged to the corresponding positions.

According to a fourth aspect of the invention, in the ink jet printing apparatus according to the second aspect of the invention, the head is of a serial scan type, the printing apparatus provides one of areas exceeding a printing range with a preliminary discharge position for the ink and a preliminary discharge position for the image quality enhancing liquid, which is disposed adjacently to the preliminary discharge position for the ink, and the control unit controls a discharge timing in such a manner that the liquids are preliminarily discharged to the corresponding positions.

According to a fifth aspect of the invention, in the ink jet printing apparatus according to the second aspect of the invention, the head is of a serial scan type, the printing apparatus provides one of areas exceeding a printing range with a preliminary discharge position for the ink, and a discharge timing is controlled so that the ink is preliminarily discharged to the preliminary discharge position for the ink, and the image quality enhancing liquid is preliminarily discharged onto a recording medium.

According to a sixth aspect of the invention, in the ink jet printing apparatus according to the second aspect of the invention, the head is of a full-line type, the printing apparatus includes a carrier belt for carrying the recording medium, and the control unit performs control of preliminarily discharging the ink onto the carrier belt and-preliminarily discharging the image quality enhancing liquid onto the recording medium.

According to a seventh aspect of the invention, in the ink jet printing apparatus according to the sixth aspect, a unit for making the liquid discharging position coincident with each other includes a sensor for detecting an upper end of paper, a head-to-head delay counter for counting a carrier distance to a printing head with a sensor signal serving as a trigger, a paper position counter actuated with a counter signal serving as a trigger, a head-to-head delay counter for counting a carrier distance to a next printing head, a comparing circuit for comparing a signal of the paper position counter with a signal of a printing area designation register and outputting a printing signal, and a comparing circuit for comparing the signal of the paper position counter with a signal of a preliminary discharge area designation register and outputting a preliminary discharge signal.

According to an eighth aspect of the invention, the ink jet printing apparatus according to the sixth aspect of the invention further comprises a cleaning unit for cleaning the ink discharged onto the carrier belt.

According to a ninth aspect of the invention, in the ink jet printing apparatus according to the second aspect of the invention, the head is of the full-line type, the recording apparatus includes a carrier belt for carrying the recording medium, and the control unit performs control of preliminarily discharging of the image quality enhancing liquid to a first position on the carrier belt, and preliminarily discharging of the ink to a second position adjacent to the first position with a spacing therebetween.

According to a tenth aspect of the invention, the ink jet printing apparatus according to the seventh aspect of the invention further comprises a cleaning unit for cleaning the ink discharged onto the record carrier belt, the cleaning unit having a circumferential length corresponding to a distance containing a width of the first position, a width of the second position, and an adjacent spacing between the first and second positions.

According to an eleventh aspect of the invention, in the ink jet printing apparatus according to the first aspect of the invention, a recording unit for printing a printed material includes an electrothermal converting element for generating an energy for discharging the ink.

According to a twelfth aspect of the invention, in the ink jet printing apparatus according to the eleventh aspect of the invention, the ink is discharged out of a discharge port by utilizing layer boiling occurred in the ink with the thermal energy applied by the electrothermal converting element.

The constructions given above make it feasible to improve a re-usability of the inks and to maintain the cleaning function of the cleaning member for a carrier medium or a transfer medium, and to thus enhance the easiness of processing the disposal inks. Further, it is possible to reduce the costs for the ink jet printing apparatus and to hold the performance thereof.

These together with other objects and advantages which will be subsequently apparent, reside in the details of construction and operation as more fully hereinafter described and claimed, reference being had to the accompanying drawings forming a part hereof, wherein like numerals refer to like parts throughout.

Other objects and advantages of the present invention will become apparent during the following discussion in conjunction with the accompanying drawings.

BRIEF DESCRIPTION OF THE DRAWINGS

FIG. 2 is a block diagram showing a control apparatus of the printing apparatus;

DESCRIPTION OF THE PREFERRED EMBODIMENTS

Embodiments of the present invention will hereinafter be described with reference to the accompanying drawings.

Figure 1:
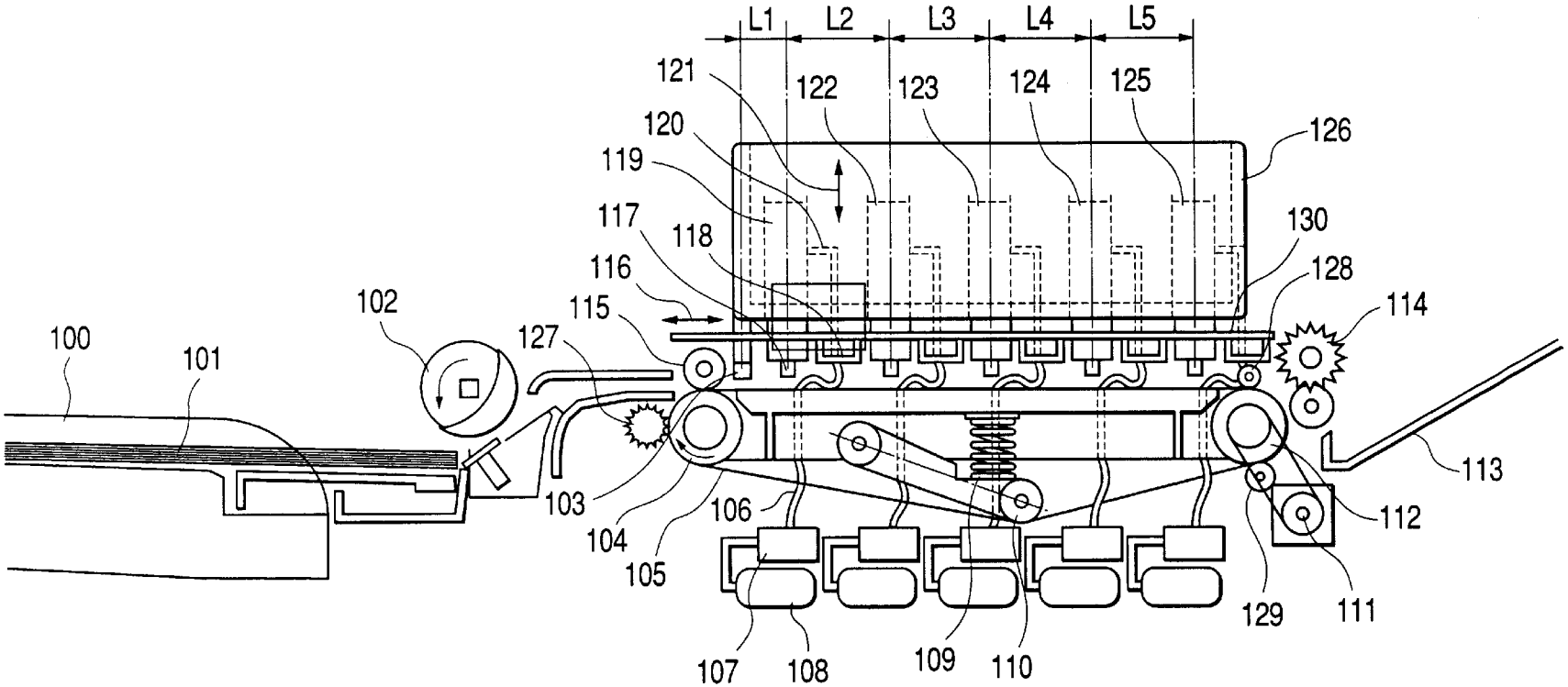
FIG. 1 is a view showing a construction of an ink jet printing apparatus.

FIG. 1 is a view illustrating a construction of a typical ink jet printing apparatus. Referring to FIG. 1, a printing paper supplying apparatus is constructed as follows. Sheets of printing paper 101 defined as printing mediums are stacked in a paper feeding cassette 100.

A pick-up roller 102 is rotated in this state, and the first printing paper 101 is thereby carried to a printing unit. Actuation of a sheet carrying unit of a carrier apparatus is started simultaneously with the printing paper pick-up process described above. A carrier drive energy is given upon rotations of a driving motor 111.

The driving motor 111 is classified as a pulse motor of which a rotating speed and a rotational quantity are open-controllable. The driving motor 111 can be precisely controlled by a phase signal transmitted from a carrier control apparatus. With the rotations of the driving motor 111, a rotational energy is transmitted to a driving roller 112 and a carrying roller 104, and a carrier belt 105 starts rotating with the rotations of the two rollers 112, 104. Therefore, a carrying velocity of the carrier belt 105 can be easily controlled by controlling the rotating speed of the driving motor 111.

Further, in order to prevent a slippage between the two rollers 112, 104 and the carrier belt 105 by giving a fixed tension to the carrier belt 105, a belt flexure preventing roller 110 pressed by a belt flexure preventing spring 109 acts on the carrier belt 105. Moreover, a high voltage is applied to an electric supply roller 127 for supplying the carrier belt 105 with a static electricity for electrostatically adsorbing the printing paper 101 to the carrier belt 105.

With the operation described above, there is also performed an operation of moving the printing head to a printing position. The respective printing heads are attached to a head unit 126 defined as a printing apparatus, and the head unit 126 is movable in a vertical direction 121. Further, a nozzle unit 117 of each printing head is capped with a cap 118 when in a non-printing state, and a cap unit 130 is movable in a bilateral direction 116.

Upon a start of the print, the head unit 126 temporarily rises, and the cap unit 130 is moved right and left, thereby uncapping the cap 118. Thereafter, the head unit 126 descends down to the printing position. FIG. 1 shows a state where the printing head unit 126 is lowered down to the printable position.

Referring again to FIG. 1, what is illustrated therein is the head unit 126 mounted with five types of printing heads arranged sequentially from the right side in FIG. 1 such as a fifth head 125 for a yellow print, a fourth head 124 for a print in magenta, a third head 123 for a print in cyan, a second head 122 for a print in black, and a first head 19 for a printability enhancing liquid.

Furthermore, the printing head includes an ink supply tube 120 serving as an ink flow path for supplying the ink, and a disposal ink tube for disposing of the disposal ink. The ink supply tube 120 for the printing serves to supply the ink toward the printing heads from a sub-tank 107. Furthermore, the ink used for recovering a function of the printing head is discharged toward the sub-tank 107 via the cap 118 from the nozzle unit 117 of the printing head. A tube for connecting the nozzle unit 117 to the sub-tank 107 is an ink supply recovery tube 106.

The sub-tank 107 is disposed for obtaining a fixed liquid level difference with respect to a nozzle surface which is required in the ink jet printing apparatus, and an ink tank 108 serves as an ink supplying apparatus, wherein a portion therebetween is connected by a tube.

In the construction discussed above, the printing paper, when fed out of the.paper feeding cassette 100, is brought into close contact with the carrier belt 105 by a close-fitting roller 115. At this time, the carrier belt 105 remains in a charged state by the electric supply roller 127, and hence the printing paper 101 is adsorbed to the carrier belt 105. The printing paper 101 carried in the above state passes through under a TOF sensor 103. At this moment, the print controlling apparatus is actuated. Let L1 be a distance between the printability enhancing liquid printing head 119 and the TOF sensor 103, and, after counting an elapse of the time required for the carrier belt 105 to move the distance L1 from the moment when the printing paper 101 passes under the TOF sensor 103, the printability enhancing liquid printing head 119 starts printing. Similarly, let Ln (n=2 to 5) be an interval between the printing heads, and each of the printing heads starts printing after the printing paper 101 has been carried a distance given by $L1+\Sigma Lm$(m=2 to 5) after the TOF sensors 103 has made a TOF confirmation of the printing paper 101. Herein, when m=2, it indicates a case of the black ink printing head, and, when m=5, it indicates a case of the yellow ink printing head.

The carrier belt 105 reaches a de-electrifying roller 128 and is thereby de-electrified, and hence the printing paper 101 printed by the procedures described above becomes easily separable from the carrier belt 105. The printing paper 101 is thus separated due to a curvature of the driving roller 111 and discharged by a sheet discharge roller 114 into a discharged sheet tray 113. In the construction explained above, the second printing paper 101 as a next sheet of printing paper, upon detecting a rear end of the printing paper 101 by the TOF sensor 103, is picked up by the pick-up roller 102 and carried by the carrier apparatus to the printing apparatus, in which the sheet 101 is printed.

Given therefore between the first and second sheets of printing paper is a spacing corresponding to a moving distance of the carrier belt till an upper end of the second sheet is detected by the TOF sensor 103 since the pick-up roller has picked up the second printing paper after the lower end of the first printing paper passed under the TOF sensor 103. Accordingly, the print control apparatus of each printing head is capable of confirming an image printing position from an upper or lower end signal of the sheet which is transmitted from the TOF sensor 103 and from a rotational quantity of the driving motor 111, and further capable of distinguishing the first printing paper from the second printing paper.

As shown in FIG. 1, the printability enhancing liquid printing head 119 is disposed most upstream of the start-of-print position, and four types of printing heads using dye inks are disposed downstream thereof. In the above-described construction of the printing head, a printability enhancing liquid used by the printability enhancing liquid printing head 119 is substantially colorless clear and transparent, and a result of the printing is discriminated with a difficulty even when coated over the printing paper as compared with the dye inks used by other printing heads. Therefore, the printability enhancing liquid is preliminarily discharged to an arbitrary position on the printing paper in the process of its being carried by the carrier belt, which therefore involves a means for ensuring a nozzle discharging reliability. Further, each of the printing heads using other dye inks preliminarily discharges the ink between the first and second sheets of printing paper, whereby the nozzle discharging reliability can be ensured. Namely, only the preliminarily discharged dye inks exist on the printing belt, and a cleaning roller 129 defined as a cleaning apparatus becomes possible of its being constructed of an ink absorbing member for cleaning only the dye inks.

FIG. 2 is a block diagram showing a control unit of the printing apparatus. A position A of the carrier apparatus illustrated in FIG. 4 is connected to a position A shown in FIG. 2. Further, the printing paper supplying apparatus is shown in FIG. 3.

Shown herein is a diagram of a construction of mechanism in which the attention is paid to the preliminary discharge when in the printing process. As shown in FIG. 3, the printing paper supplying apparatus is constructed so that a paper feeding timing generation circuit 215 gives a timing at which the pick-up roller is rotated in order to pick up the printing paper out of the paper feeding cassette at the start of the printing. A paper feeding driving apparatus 214 rotates a pick-up motor 213 at this timing.

Further, for simultaneously driving the carrier belt, as shown in FIG. 4, a carrier driving timing circuit 202 generates a pulse driven with a fixed period, and this pulse is transmitted to a carrier apparatus driving apparatus 201, in which a rotary force of a pulse motor 200 for rotating the carrier belt is generated. At this time, a feeding quantity of the carrier belt is set 1/n or n-times a raster resolution of the printing paper.

Figure 3:
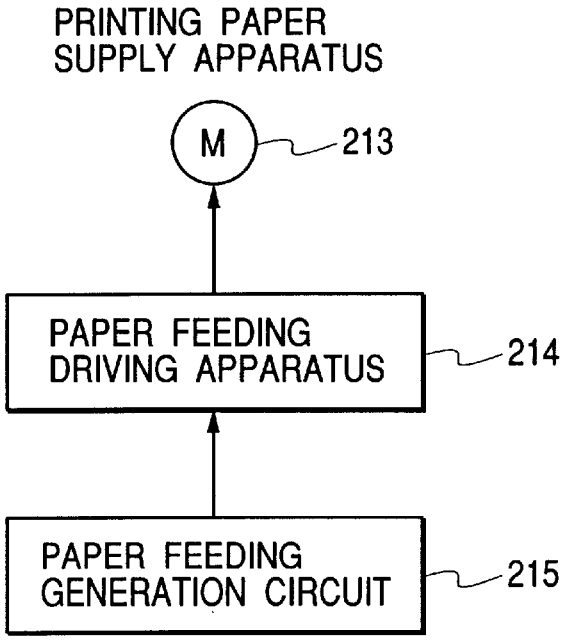
FIG. 3 is a diagram showing a printing paper supplying apparatus.
Figure 4:
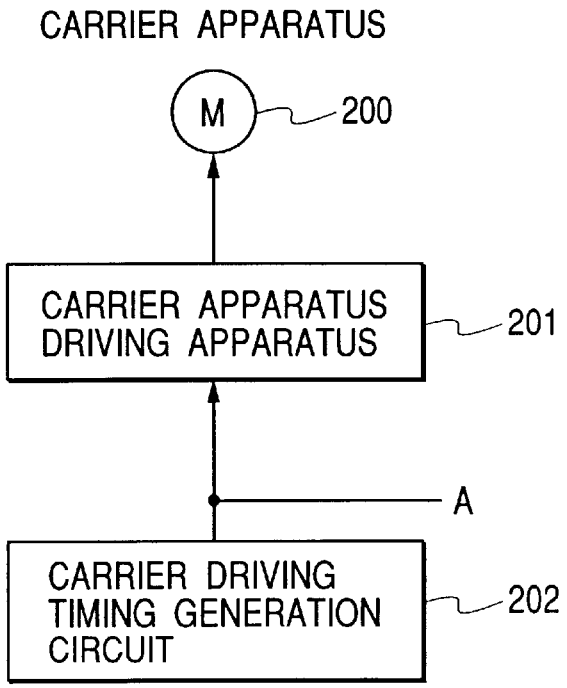
FIG. 4 is a diagram showing a carrier apparatus.

Referring to FIGS. 2 to 4, it is assumed that the raster resolution and a driving pulse phase of the carrier belt show a one-to-one-correspondence. Namely, the mechanism is that when a phase of the pulse motor 200 is advanced by one, the carrier belt moves by one raster of the print image. When the printing paper is carried to the printing apparatus, the print control apparatus starts operating, and, to begin with, the upper end of the paper is detected by the TOF sensor 203.

With this signal serving as a trigger, there starts an operation of a paper position counter 206 of each printing head which is. provided in a counter unit 204. With a trigger of the TOF sensor 203, there begins an operation of a head-to-head delay counter (L1) 205 for counting a carrier distance from the TOF sensor to the printability enhancing liquid printing head. The carrier distance is measured by counting the number of carrier driving timing pulses. Herein, the printability enhancing liquid printing head is referred to as a first head, the black ink printing head is termed a second head, and other heads are likewise referred to as a third head, a fourth head and a fifth head.

The head-to-head delay counter (L1) 205 is cleared when a counter value becomes 0 from L1, and outputs a trigger signal to a next output port. Then, the head-to-head delay counter (L1) 205 stops operating until the trigger signal is again inputted thereto. The carrier apparatus is therefore in such a state that the upper end of the printing paper passes under the TOF sensor 203 and thereafter the printing paper moves a distance L1, in which state the upper end of the printing paper comes just under the first head. At this time, the head-to-head delay counter (L1) 205 effects a start trigger upon a head-to-head delay counter (L2) as well as on a paper position counter (1) 206 conceived as a second counter, and then halts.

Incidentally, when an area extending from the upper end of the printing paper down to the lower end thereof is expressed by the number of rasters, the upper end of the sheet is expressed as a first raster, the lower end of the sheet is an M-th raster, and a distance up to the upper end of the next printing paper is an N-th raster. Herein, a start-of-print raster position of the printing area excluding upper and lower end margins of the paper, is referred to as an H-th raster position, and a final raster position of the sheet is termed an F-th raster position.

A printing area designation register 207 shown in FIG. 2 is stored with a H-th raster value and an F-th raster value. When a value of the paper position counter (1) 206 is between "H" and "F", the output signal is asserted in a comparing circuit 209 but is negated in cases other than,this. Namely, a state where this signal is asserted indicates an execution of the printing. Hence, this signal (which will be hereinafter referred to as a heat window signal) turns out to be a print command signal within a data creating unit 211. Further, similarly a value of a first head preliminary discharge area designation register is set. This setting process is implemented for printing the data excluding the printing data in order to ensure a discharge stability of the nozzle within the printing head. A preliminary discharge area can be set in an arbitrary position in an arbitrary area ranging from the first raster to the N-th raster. Supposing that the preliminary discharge start position is referred to as an h-th raster position and a preliminary discharge end position is termed an f-th raster position, it is judged by using the paper position counter whether or not the present raster position is in the preliminary discharge area.

In the case of the first head, if the paper position counter (1) 206 exists between "h" and "f" of the first head preliminary discharge area designation register 208, a preliminary discharge signal is asserted from the comparing circuit 209. For the duration of the assertion of this signal (which is hereinafter referred to as a preliminary discharge window signal), there is performed the control of executing the preliminary discharge. In the case of the first head 212, the ink to be used is the printability enhancing liquid of which the color is transparent or as close as transparent, and therefore a printed result can not be recognized even when the preliminary discharge is effected on the printing paper, with the result that the values "h" and "f" of the preliminary discharge positions are assumed to be on the printing paper, and the preliminary discharge is executed on the printing paper.

The preliminary discharge positions of other-heads are set between the M-th raster and the N-th raster. With this setting, the preliminary discharge is effected between the first printing paper and the second printing paper. A data creating unit 211 creates the printing data and generates a driving signal. In the case of the first head 212, the data creating unit (for the first head) 211 executes inside the printing data processing.

Figure 5:
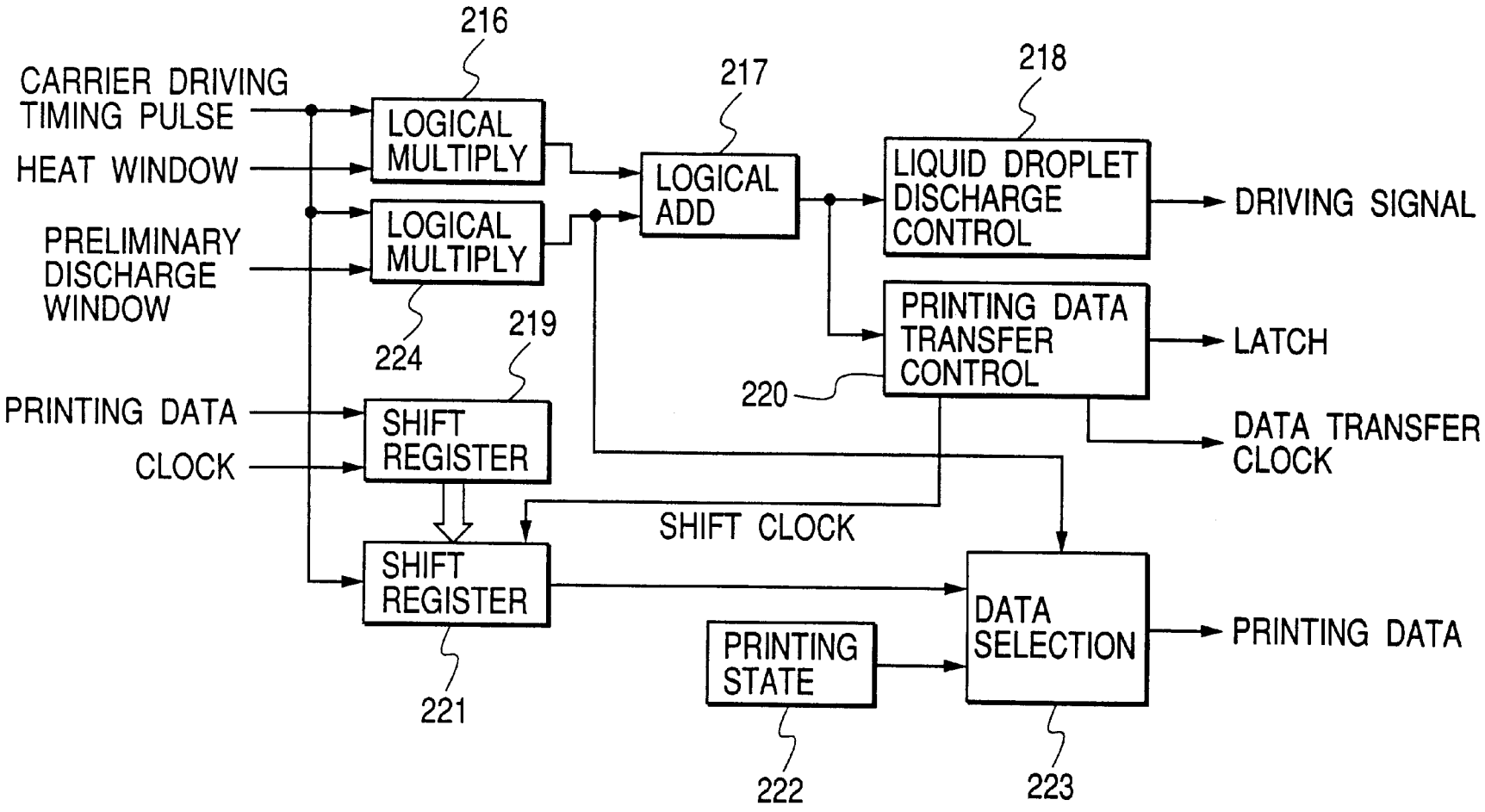
FIG. 5 is a block diagram showing a data creating unit.

FIG. 5 is a diagram illustrating an internal configuration of the data creating unit. In the data creating unit, a data input apparatus 210 inputs the printing data to a shift register 219, synchronizing with a clock. At a point of time when the data for one raster are inputted to the shift register 219, a content of the shift register 219 is transferred to a shift register 221 in accordance with a carrier driving timing pulse. Based herein.on the carrier driving timing pulse signal, the printing data are created, and a liquid droplet discharge driving signal is generated.

Liquid droplet discharge control 218 and printing data transfer control 220 are started based on a logical ADD of a logical multiply 216 of the carrier driving timing pulse and a heat window, and of a logical multiply 224 of the carrier driving timing pulse and a preliminary discharge window. The driving pulse signal etc. is generated in the liquid droplet discharge control 218. In the printing data transfer control 220, a shift clock is transmitted to the shift register 221. In the shift register 221, the printing data are serially transmitted synchronizing with the shift register. Further, a data selection 223 implies a selection circuit, and preliminary discharge data 224 is selected in a state where a signal of the logical multiply of the carrier driving timing pulse and the preliminary discharge window is asserted. In states other than the above-mentioned state, the printing data are selected. The preliminary discharge data 224 for controlling discharge data when in the preliminary discharging process normally shows a full-nozzle print, and the preliminary discharge indicates all the nozzles to discharge the inks. Accordingly, a position of the preliminary discharge window in terms of carrying the paper is controlled, whereby the preliminary discharge can be done in any portions in the same circuit.

Figure 6:
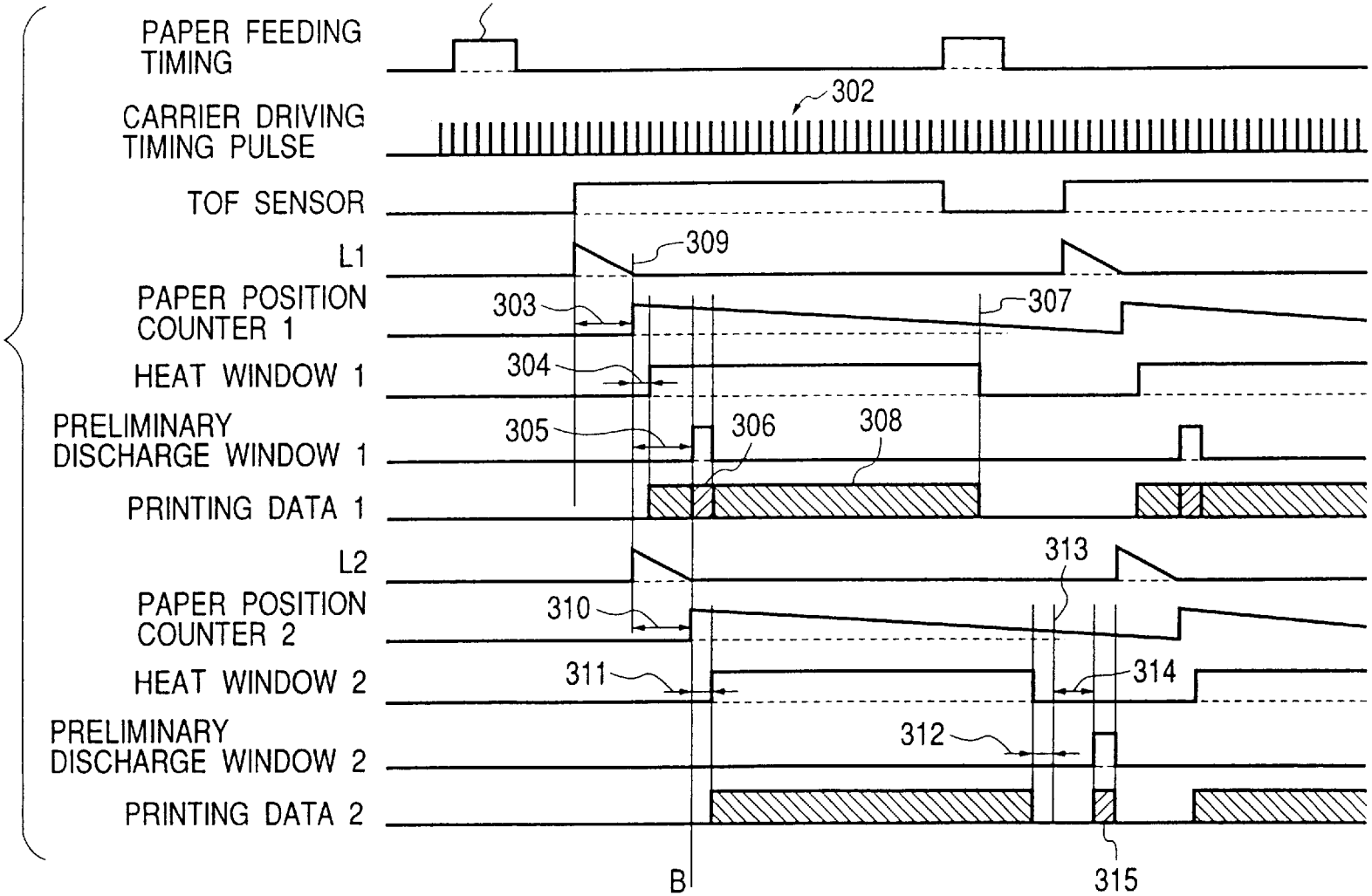
FIG. 6 is a timing chart.
Figure 7:
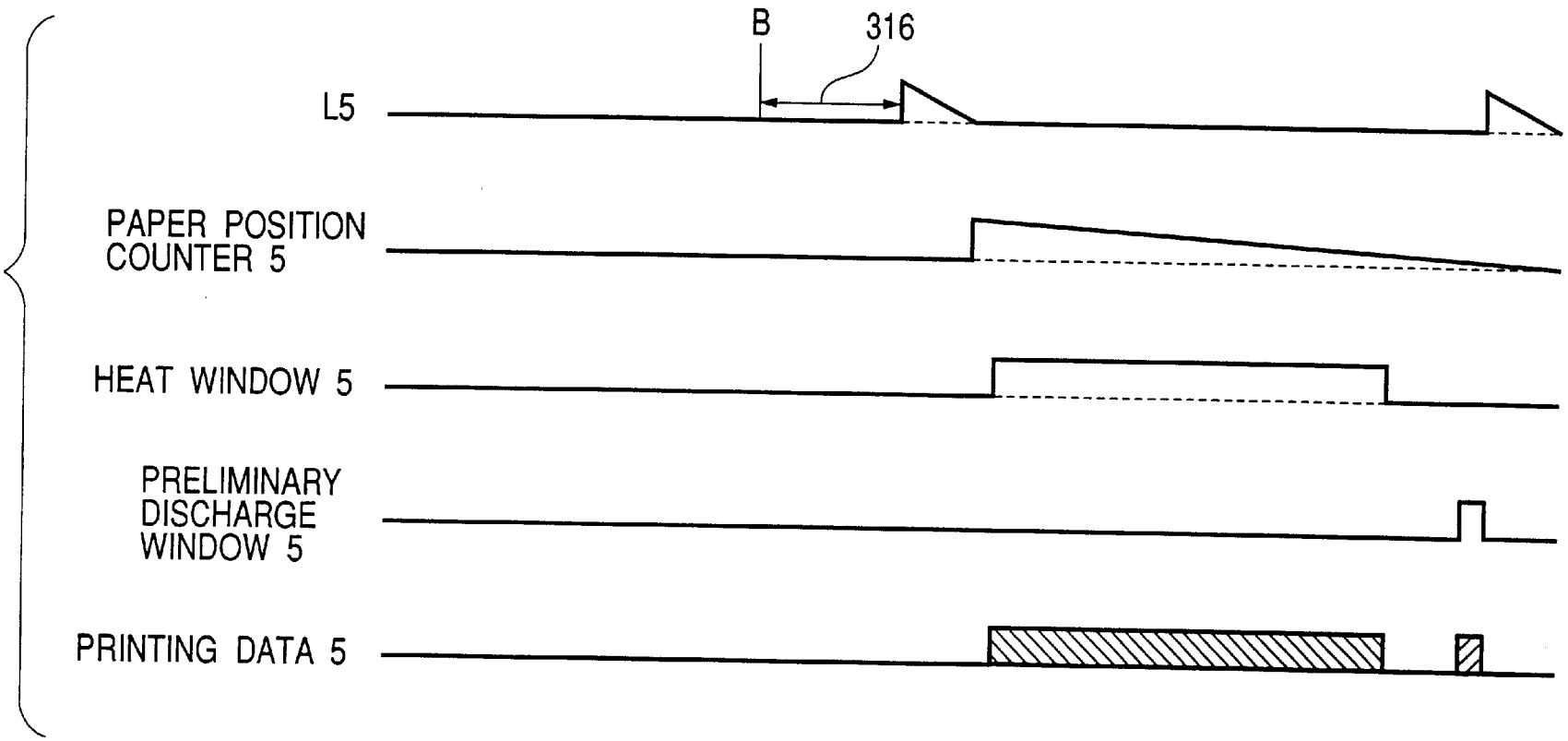
FIG. 7 is a timing chart continued from the timing chart in FIG. 6.

FIG. 6 is a timing chart. A position B in a timing chart shown in FIG. 7 is connected to a position B in FIG. 6.

When starting the printing, a paper feeding timing signal 301 for feeding the printing paper is asserted in the printing apparatus. Further, at the same time, an actuation of a carrier driving timing pulse 302 is started.

The printing paper adsorbed onto the carrier belt passes through a sense point of the TOF sensor for detecting the upper end of the printing paper. The printing paper remains at the sense point of the TOF sensor, during which the TOF sensor continues to assert the TOF signal. A value of the head-to-head delay counter (L1) is preset at a rising end of the TOF sensor. The delay counter (L1) counts 303 the number of the paper carrier timing pulses required for moving a distance from the TOF sensor to the first head, and stops 309 the operation when the upper end of the printing paper arrives at just under the nozzle of the first head. The paper position counter (1) starts operating, wherein a stop timing 309 of the head-to-head delay counter (L1) serves as a trigger. The paper position counter (1) is preset before counting the number of paper carrier timing pulses necessary for moving a distance to the next printing paper, and continues a countdown till the counter value becomes 0.

For the printing, the heat window is asserted after a paper carrying time at 304 has elapsed since a timing 309 at which the paper position counter (1) starts operating, and the preliminary discharge window is asserted after a paper carrying time at 305 has elapsed since the timing 309 at which the paper position counter (1) starts operating and is negated after counting an arbitrary number of preliminary discharge pulses.

In the case of the first head, the position for implementing the preliminary discharge is on the printing paper, and the discharge data becomes data taking a logical ADD of the printing data and the preliminary discharge data. The printing by the first head is negated at a timing 307 when an arbitrary margin at the lower end of the paper. Referring to FIG. 6, oblique lines 308 indicate that the printing data itself is printed, and a part 306 indicates that the logical ADD data of the printing data and the preliminary discharge data are printed.

The head-to-head delay counter (L1) of the second head starts operating upon reaching a stop timing 309 of the head-to-head delay counter (L1). The head-to-head delay counter (L2) has the same function as that of the head-to-head delay counter (L1) described above, and stops operating when counting a distance between the first and second heads.

A head-to-head delay counter (L3) starts operating upon the halt of the head-to-head delay counter (L2). The printing area remains unchanged without depending on the printing heads, and hence the upper end margin, the printing area and the lower end margin with respect to the second head, are the same as those of the first head. More specifically, referring to FIG. 6, 304 and 311 for determining an upper end margin quantity are the same.

The preliminary discharge position of the second head is, however, different from the first head. There has passed a time 312 after the heat window 2 is negated, and thereafter the lower end of the printing paper passes just under the nozzle of the second head. The preliminary discharge window 2 is asserted with a time delay 314 from a timing 313. At this preliminary discharge timing, the printing paper does not exist just under the nozzle of the second head, and it follows that the preliminary discharge onto the carrier belt is carried out.

A preliminary discharge 315 at this time corresponds to data for the,preliminary discharge. As in the case of the printing control of the second head, a printing timing of a fifth head is after the stop of the operation of the delay counter (L2), and, as shown in FIG. 7, after a time 316 has elapsed, a head-to-head delay counter (L5) starts operating.

Figure 8:
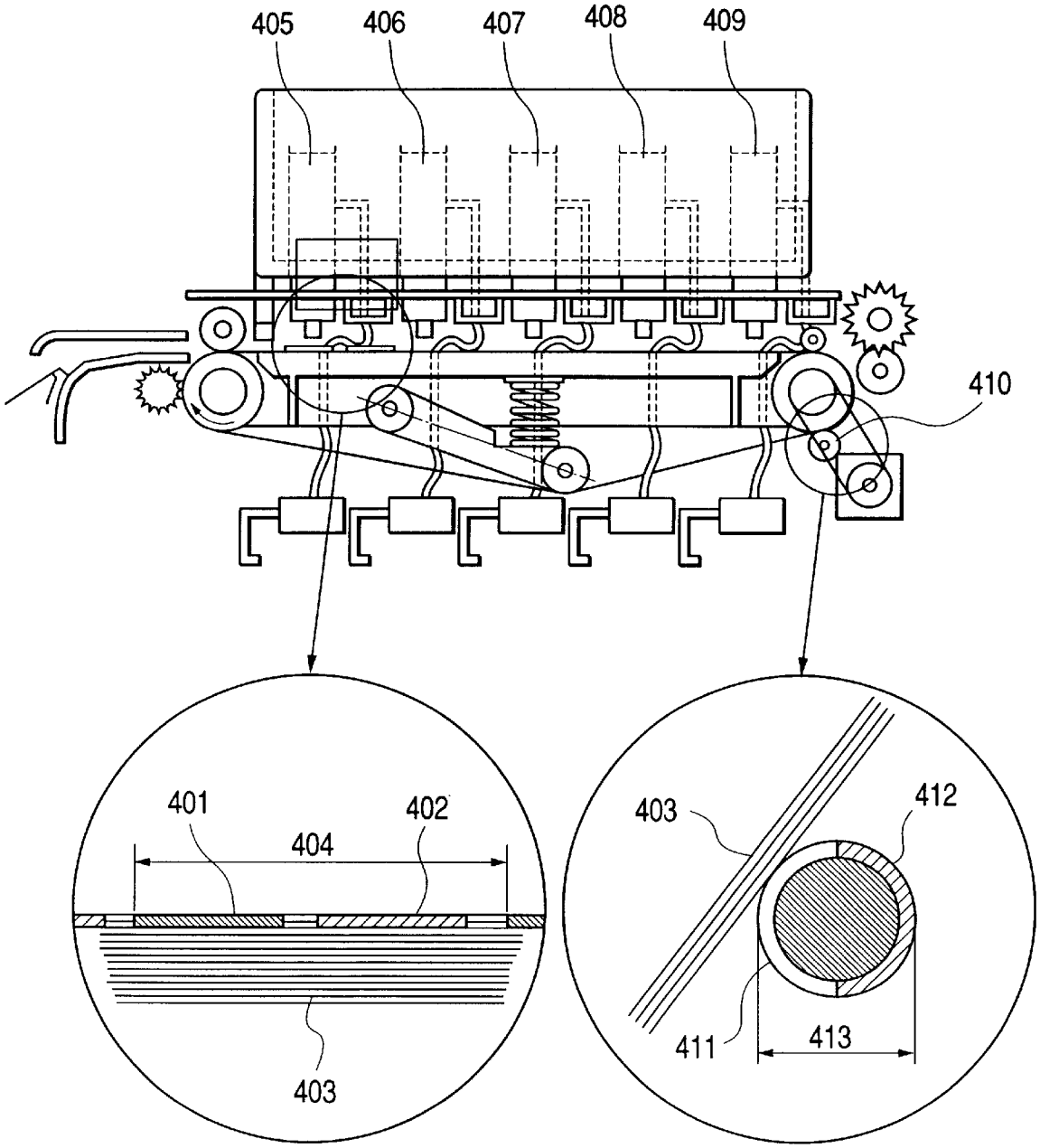
FIG. 8 is a view illustrating another embodiment.

FIG. 8 shows another embodiment. Referring to FIG. 8, the numeral 405 represents a first head for discharging the printability enhancing liquid, and the numerals 406 through 409 designate second through fifth heads for discharging the dye inks.

A carrier belt 403 having the present construction is shown in a circle in a lower portion of the first head 405. A configuration of a carrier belt cleaner 410 is illustrated in a circle in a right lower portion in FIG. 8. Preliminary discharge receiving portions 401 for the printability enhancing liquid and preliminary discharge receiving portions 402 for the dye ink, are alternately disposed on a base member of the carrier belt 403, and a period thereof is 404.

On the other hand, the carrier belt cleaner 410 is a member brought into contact with the carrier belt 403 and so constructed as to absorb the preliminary discharge liquid. A circumferential length (3.13×cleaner's diameter 413) of the carrier belt cleaner 410 is coincident with a preliminary discharging portion period 404 on the base member of the carrier belt 403. Further, the carrier belt is so structured as to be a multiple of integer of the preliminary discharge portion period.

According to the construction discussed above, the ink adhered to the preliminary discharge receiving portion (for the printability enhancing liquid) 401 and the ink adhered to the preliminary discharge receiving portion (for the dye ink) 402, are respectively separated in terms of their areas and thus adhered to the cleaner portion (for the printability enhancing liquid) 412 of the carrier belt cleaner 410 and to the cleaner portion (for the dye ink) 411 thereof, whereby an optimal cleaning process can be executed without mixing the two kinds of ink liquids on the carrier belt cleaner 410.

As discussed above, according to the present invention, the preliminary discharging positions are set the same per attribute of the ink. With this contrivance, as exemplified in the embodiment discussed above, the ion coupling of the anion radical and the cation radical on the carrier belt is prevented, thereby making it easier to recover the ink liquids on the carrier belt.

Note that the form of the recording head for discharging the ink and the printability enhancing liquid is not limited to the above-described full-line type and can be applied to a printer of such a type that the recording head is mounted on a carriage and performs the recording by effecting serial scans. The serial scan type printer can be constructed such that, for example, the preliminary discharge receiving member for the ink is disposed in one area, while the preliminary discharge receiving member for the printability enhancing liquid is disposed in the other area with the recording area interposed therebetween, and there is performed the control of respectively discharging the ink and the printability enhancing liquid. Further, as a matter of course, the preliminary discharge receiving member and the preliminary discharge receiving member for the printability enhancing liquid may be disposed adjacently in one area, and the preliminary discharges can be individually executed by controlling the discharge timing. Furthermore, the printability enhancing liquid may be preliminarily discharged onto the recording paper, and the ink may also be preliminarily discharged onto the ink preliminary discharge receiving member disposed in one area.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An ink jet printing apparatus including a plurality of heads for discharging liquids used for plural types of prints each exhibiting a different attribute, said apparatus comprising:

control means for adjusting and controlling a timing of a preliminary discharge for maintaining a discharge not contributing to records by said plurality of heads, per attribute of the liquids to be discharged in such a manner that droplets of the liquids exhibiting a same attribute are discharged to a same position, wherein the liquids exhibiting the different attributes are an ink containing a coloring agent, and a liquid, not containing the coloring agent, for enhancing a quality of an image formed by the ink, wherein each of said plurality of heads is of a full-line type, wherein said printing apparatus includes a carrier belt for carrying a recording medium, and wherein said control means performs control in such a manner that the ink is preliminarily discharged onto said carrier belt and the image quality enhancing liquid is preliminarily discharged onto the recording medium.

2. An ink jet printing apparatus according to claim 1, wherein the control means includes:

a sensor for detecting an upper end of paper;

a head-to-head delay counter for counting a carrier distance to a printing head with a sensor signal serving as a trigger;

a paper position counter actuated with a counter signal serving as a trigger;

a head-to-head delay counter for counting a carrier distance to a next printing head;

a comparing circuit for comparing a signal of said paper position counter with a signal of a printing area designation register and outputting a printing signal; and a comparing circuit for comparing the signal of said paper position counter with a signal of a preliminary discharge area designation register and outputting a preliminary discharge signal.

3. An ink jet printing apparatus according to claim 2, further comprising:

cleaning means for cleaning the ink discharged onto said carrier belt, said cleaning means having a circumferential length corresponding to a distance containing a width of the first position, a width of the second position, and an adjacent spacing between the first and second positions.

4. An ink jet printing apparatus according to claim 1, further comprising:

cleaning means for cleaning the ink discharged onto said carrier belt.

5. An ink jet printing apparatus according to claim 1, wherein each of the plurality of heads for printing a printed material includes an electrothermal converting element for generating an energy for discharging the ink.

6. An ink jet printing apparatus according to claim 5, wherein the ink is discharged out of a discharge port in each of the plurality of heads by utilizing layer boiling occurring in the ink with the thermal energy applied by said electrothermal converting element.

* * * * *

UNITED STATES PATENT AND TRADEMARK OFFICE

CERTIFICATE OF CORRECTION

PATENT NO. : 6,402,292 B1
DATED : June 11, 2002
INVENTOR(S) : Ninomiya

It is certified that error appears in the above-identified patent and that said Letters Patent is hereby corrected as shown below:

Column 2,
Lines 23 and 24, “a:ph-enomenon” should read -- a phenomenon --;
Line 24, “contain” should read -- contained --;
Line 28, “solved” should read -- dissolved --; and
Line 34, “the-color” should read -- the color --.

Column 4,
Line 5, “and-” should read -- and --; and
Line 10, “postion” should read -- positions --.

Column 6,
Line 8, “first head 19” should read -- first head 119 --;
Line 26, “the.paper” should read -- the paper --; and
Line 43, “sensors 103” should read -- sensor 103 --.

Signed and Sealed this

Twenty-second Day of April, 2003

JAMES E. ROGAN
*Director of the United States Patent and Trademark Office*